United States Patent [19]

Noens

[11] 4,041,448

[45] Aug. 9, 1977

[54] ELECTRONIC RAILROAD TRACK MARKER SYSTEM

[75] Inventor: Richard H. Noens, Arlington Heights, Ill.

[73] Assignee: Vapor Corporation, Chicago, Ill.

[21] Appl. No.: 711,996

[22] Filed: Aug. 5, 1976

[51] Int. Cl.[2] ..... G08C 25/00; G08C 21/00

[52] U.S. Cl. ..... 340/32; 246/167 R

[58] Field of Search ..... 340/32; 246/63 C, 167 R, 246/2 F

[56] References Cited

U.S. PATENT DOCUMENTS 3,701,102 10/1972 Berman ..... 340/32

*Primary Examiner*—Thomas B. Habecker

*Attorney, Agent, or Firm*—Francis J. Lidd

[57] ABSTRACT

A locomotive is fitted with a transmit and a receive coil. Resonant circuits are packaged within a housing that is secured at a preselected point along a railroad track to serve as a position marker. When the locomotive passes the marker, a signal is coupled from the transmit coil in the locomotive to the marker resonant circuit and back to the receiver coil in the locomotive. Discrimination circuitry is connected to the receive coil for ensuring that the received signal has a minimum amplitude and a particular phase relationship with the signal in the transmit coil. Further, the received signal must maintain these amplitude and phase relationships for a preselected count. Upon proper discrimination, a "mark" signal is generated to an event recorder on board the locomotive.

11 Claims, 7 Drawing Figures

ELECTRONIC RAILROAD TRACK MARKER SYSTEM

FIELD OF THE INVENTION

The present invention relates to railroad signalling apparatus and more particularly to an on-board system for detecting the location of a marker at a preselected point along a track.

BRIEF DESCRIPTION OF THE PRIOR ART

During the present time, railroads are performing a multitude of operational tests during a train run. The recording of specific events during the run is necessary to evaluate operation of a train in accordance with prescribed events. An appropriate system is disclosed in U.S. Pat. No. 3,864,731, assigned to the present assignee. In the system of this prior patent it is necessary to record marker signals at different points along the track so that the data collected may be correlated with positional points along the track.

In the past, a number of approaches have been taken for detecting the passage of a locomotive at a particular point along a railroad track whereat an electronic marker of some sort is located.

In U.S. Pat. No. 2,817,012 an inductive system for railroads is disclosed using a train carried coil that is excited by a trackway receiving coil. As in the present invention, the sensing of proximity is done by the interaction of passing coils in a mutual magnetic field. The disturbance of that field generates a signal which is further processed. In the referenced U.S. Pat. No. 2,817,012, there is an emphasis on vehicle identification which is performed by generating a sweeping frequency through one coil. A second coil, of a particular resonant frequency interacts with the sweeping frequency at the resonant frequency. This is detected by processing circuitry and depending upon the detected resonant frequency, a corresponding vehicle is identified. The circuitry set forth in this patent lacks the reliability of performance required for accurate track marking. This is due to the many extraneous environmental influences as well as the multitude of foreign objects located along a track bed.

U.S. Pat. No. 2,454,687 discloses a proximity sensor for vehicles. In this patent, a large coil or loop forms a perimeter through which a vehicle would pass. The introduction of the vehicle through the loop disturbs an electromagnetic field which causes a frequency shift in a circuit connected to the loop. Although this system may be a valid approach for detecting the passage of a vehicle in a particular ground area, it is not well adapted for a detection system that is mounted on board a traveling locomotive.

U.S. Pat. No. 3,281,779 is directed to a locomotive position detector and uses an irregularly shaped metal member mounted to a rail which is located in proximity to sensing heads on board a locomotive. Irregularities in the rail cause a unique readout which is recorded. As will be appreciated, the retro-fitting of rails with special metal members in a rather expensive proposition. Further, due to the rather rugged environment of rails, it is quite possible for these metal members to be broken or otherwise destroyed so that they will not actuate the position detecting mechanism.

BRIEF DESCRIPTION OF THE PRESENT INVENTION

The present invention relies upon a structurally simple system that is exceedingly dependable, particularly in the environment of railroad useage.

As a locomotive passes a marker which is set along a rail bed, a disturbance is sensed in a receiving coil, located in the locomotive. In essence, three tests are performed on a received signal to determine whether it is a valid marker signal or whether it has been included by noise, or other metallic objects that are quite common to track beds, such as switches. The tests include ascertaining whether the received signal has a minimum amplitude, which eliminates many noise signals or low amplitude. In addition, a phase relationship is checked between a transmit coil and a receive coil in the locomotive. Only when an actual marker, in the form of a resonant circuit, is detected along the track bed, will a prescribed phase relationship be detected. In addition, the prescribed amplitude test as well as the phase test must exist for a predetermined count which eliminates the detection of short spurious noise signals and objects other than a marker, along a rail bed.

Accordingly, it is the novel discrimination of the received signals which is not met by any known prior art.

The above-mentioned objects and advantages of the present invention will be more clearly understood when considered in conjunction with the accompanying drawings, in which:

DETAILED DESCRIPTION OF THE INVENTION

Figure 1:
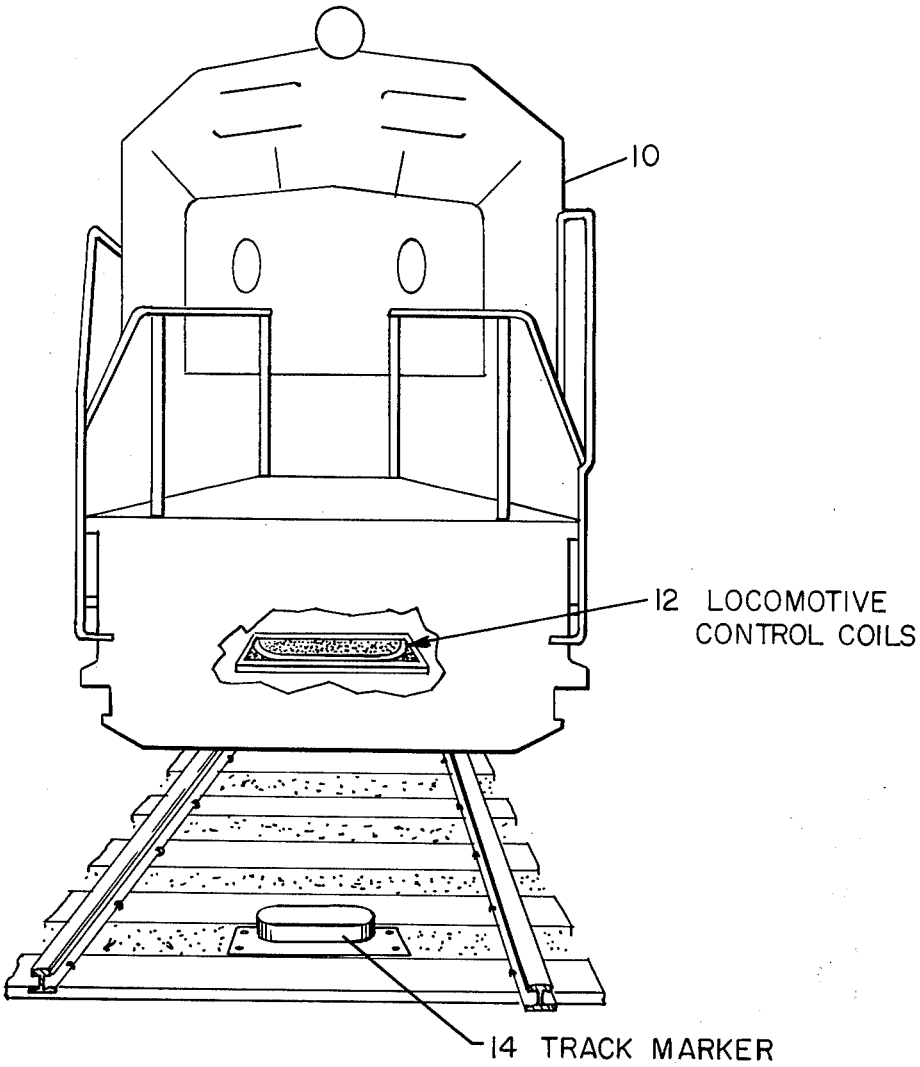
FIG. 1 is a front elevational view of a locomotive approaching a track marker.

Referring to the figures and more particularly FIG. 1 thereof, a locomotive 10 is seen traveling along a track. Along the lower frame portion of the locomotive are the locomotive control coils 12 that comprise a transmit and receive coil, as will be explained hereinafter, positioned copolanar with each other in a suitable housing. A track marker 14 is shown fastened to a tie. As will be explained hereinafter, when the locomotive 10 passes across the track area where the track marker 14 is located, the control coils 12 will pass over the track marker 14 and cause a readout to special circuitry located in the locomotive.

Figure 2:
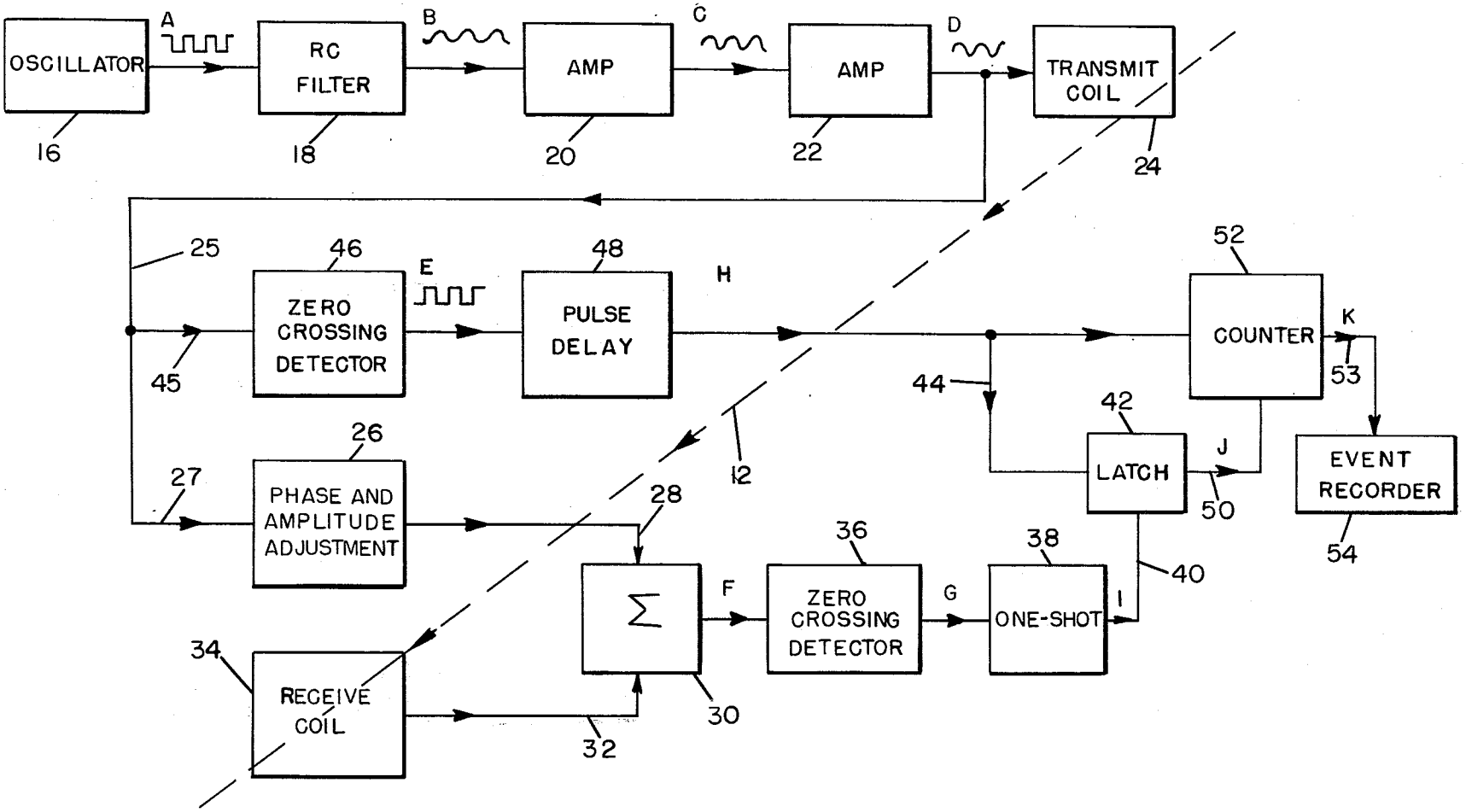
FIG. 2 is a block diagram of the present system.

Referring to FIG. 2, a functional block diagram is represented for the system. A compensated crystal oscillator 16 generates a square wave, typically operating at 100 kHz. The output from the oscillator is indicated at point "A".

This square wave signal is passed through RC low pass filter 18 so that the square wave is converted to a sine wave as shown at point "B". A first stage of amplification at 20 amplifies the sine wave signal as indicated at point "C" at the output of the amplifier 20. A second stage of amplification at 22 further amplifies the amplitude of the signal as existing at point "D" at the output of the amplifier 22. The amplified sine wave is fed to a transmit coil 24 that forms part of the control coils 12 discussed in connection with FIG. 1. The transmit coil sets up an electromagnetic field operating at the same frequency as the oscillator, in the embodiment described, this typically being 100 kHz.

Figure 3:
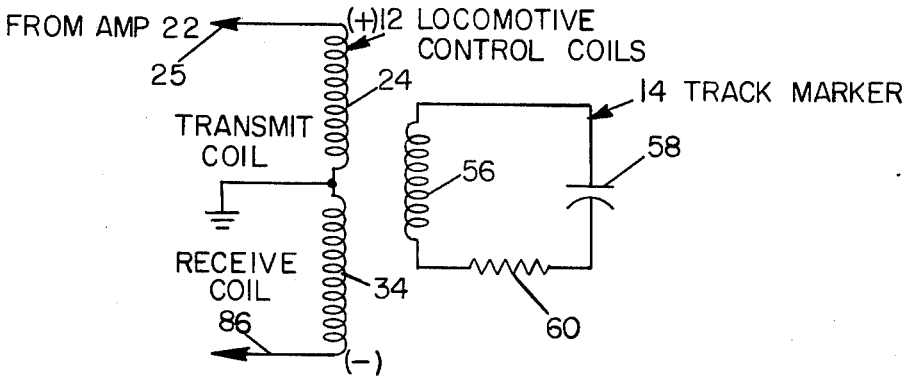
FIG. 3 is a circuit diagram illustrating the relationship between the locomotive control coils (transmit and receive) and the track member circuitry.

Referring to FIG. 3, the actual structure of the transmit and receive coil as well as the track marker circuitry is illustrated. As shown, the locomotive control coils 12 include serially wound turns constituting a transmit coil 24 and a receive coil 34. The junction between the transmit coil and the receive coil portions is grounded. The upper terminal of the transmit coil 24 is connected to the output of amplifier 22 which provides a sine signal to the transmit coil 24. The lower terminal of the receive coil 34 is connected to signal processing circuitry to be discussed hereinafter, in connection with FIG. 2. Typically, each coil 24 and 34 may be one foot in diameter while coil 24 has 22 turns and coil 34 has 40 turns. When a locomotive travels along removed from the vincinity of a track marker the receive coil 34 will always develop a signal thereacross due to the signal applied across the transmit coil 24. Accordingly, it is desirable to cancel the effect of the transmit signal in the receive coil 34, which is done by amplitude and phase adjusting circuity to be discussed hereinafter.

When the locomotive passes over a track marker 14, the signal from the transmit coil 24 is induced in track marker coil 56 which is serially connected with capacitor 58 and resistance 60 to form a resonant circuit. By way of example, coil 56 may be one foot in diameter and contain 40 turns. Typically, the resonant frequency of the track marker 14 is 96.8 KC. However, the track marker 14 is driven at the oscillator frequency — 100 kHz, slightly above its resonant frequency. The reason for this will become apparent in the later discussion of signal discrimination. When a track marker 14 is encountered by the locomotive control coils 12, a signal is reflected back to the receive coil 34 which feeds the received signal to the processing circuitry to be discussed in connection with FIG. 2.

Referring to FIG. 2, in order to cancel or null the signal which is ever present in the receive coil 34 (FIG. 3) due to the proximity to the transmit coil 24, a phase and amplitude adjustment circuit 26 is employed which has its input 27 connected to the lead 25 corresponding to point "D" in FIG. 2. The amplitude of the signal at 27 is adjusted and phase shifted 180° . The resultant signal is then summed with the steady state signal from the receive coil 34 so that interference from the transmit coil may be canceled. This is achieved by the summing amplifier 30 which has its input 28 connected to the output of the phase and amplitude adjustment circuit 26. A second input 32 of the summing amplifier 30 is connected to the receive coil 34. During locomotive travel, even remote from a track marker, the summing amplifier 30 will null the interference signal. Therefore, when the receive coil does in fact detect a track marker 14, the signal attributable to the track marker will pass through the summing amplifier 30. The remaining circuitry to be described in connection with FIG. 2 is used to discriminate between a signal from track marker 14 as distinguished from signals from other objects encountered along the track, or from noise. The signal point "F" at the output of summing amplifier 30 will be a sine wave in the event a track marker 14 is encountered. In the event that a track marker 14 is not encountered, there will be no signal at point "F". Even in the event there is a signal at point "F", it is possible that such a signal would be a low level noise signal. In order to discriminate this situation, a zero crossing detector 36 is connected to the output of the summing amplifier 30 to detect whether the signal derived therefrom has a minimum peak-to-peak voltage, typically 1.2 volts. If it does not, then the detector 36 generates no output.

If a minimum peak-to-peak voltage is present, a phase test is conducted. The detector 36 will generate a square wave at point "G" which feeds a one-shot 38 serving the purpose of shortening the duration of pulses from detector 36. The output from the one-shot 38 is indicated at point "I" which represents data fed to the first input 40 of a conventional latch circuit 42. A second input 44 to the latch circuit 42 is a clock signal derived from point "H". The signal at this point is obtained by connecting the sine wave signal on lead 25 to the input 45 of a zero crossing detector 46 which converts the sine wave to a square wave at point "E". The width of each pulse at point "E" is stretched to an adjustable interval as determined by pulse delay 48. The output of the pulse delay 48 is point "H" where the latch clock signal is derived. If the signal at latch input 40 is positive at the time a clock pulse is present at input 44, the latch circuit 42 is set at its output 50 as manifested by the signal at point "J". The purpose of the latch circuit 42 is to discriminate signals other than those caused by the track marker 14. Thus, unless a prescribed phase relationship exists between the clock at point "H" and the signal at point "I", that latch will not be set.

To further ensure that noise or signals from extraneous objects along a track do not generate an erroneous mark detection, a further precaution is taken and forms part of the discrimination process for the circuitry of FIG. 2. This further discrimination is carried out by counting a time span for which the signal at point "J" is set. Typically, it is required that this signal remain set for eight clock pulses before an output at 53 (point "K") is generated which represents a mark detection. Such a detection signal is generated at the output 53 of the counter 52 that has its first input connected to latch output 50 and its second input is connected to the pulse delay 48, from which clock pulses are derived. The mark detection signal at point "K" is connected to an event recorder 54 that is located on board the locomotive and serves to record the occurrence of a mark detection. Utilization of the data from the event recorder is relevant to a locomotive recorder system disclosed in the previously mentioned U.S. Pat. No. 3,864,731.

Figure 7:
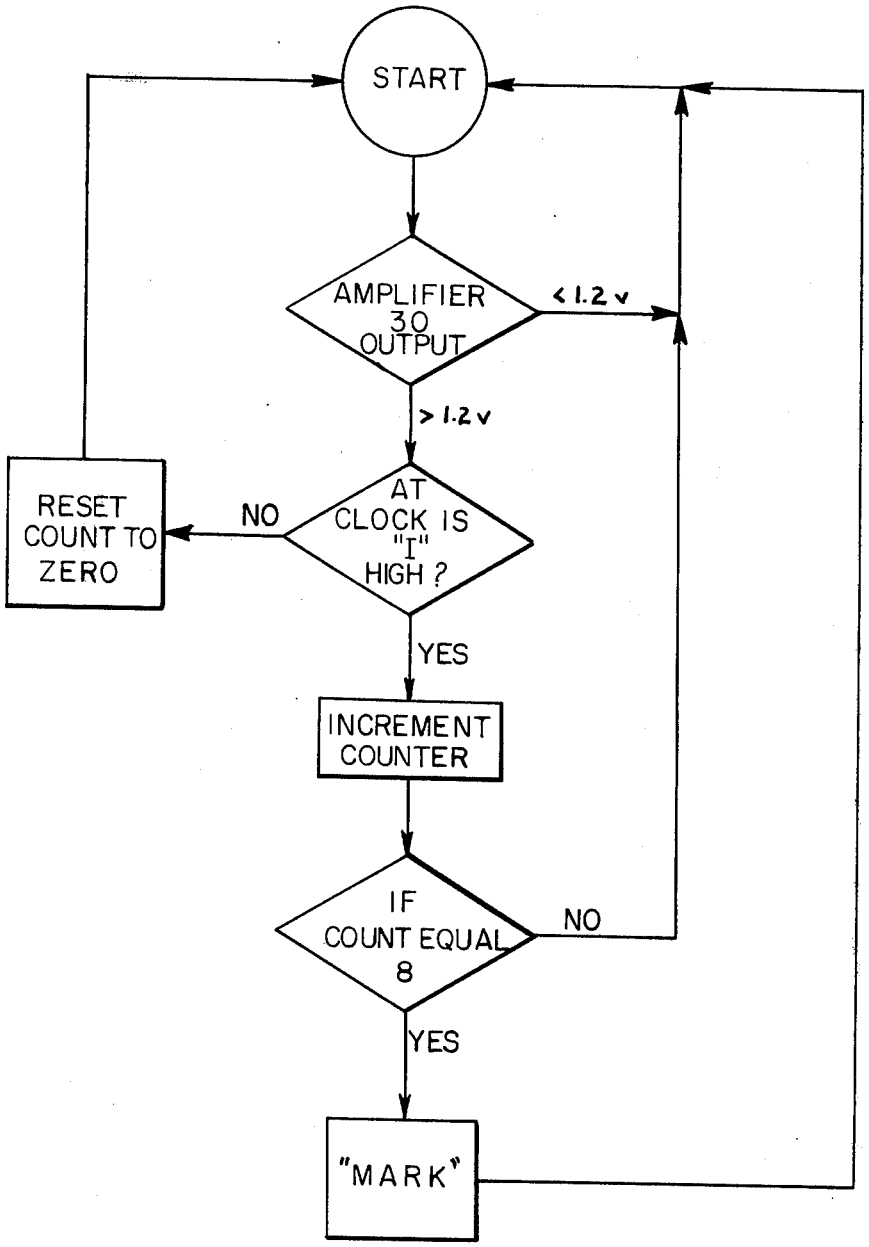
FIG. 7 is a flow diagram of the discrimination steps accomplished by the present invention.

FIG. 7 illustrates a flow chart which indicates the various steps taken by the discussed system in order to discriminate the detection of a track marker. The initial START step is followed by a decisional step to determine whether the output from amplifier 30 exceeds a particular peak-to-peak voltage, for example 1.2 volts. If it does not, the circuitry returns the system to the START condition. If it does, the succeeding decisional step is carried out whereby the signal at point "I" is sampled at the beginning of a clock pulse. This occurs at latch circuit 42. If it is, the counter 52 is incremented. If it is not, the counter 52 is reset to zero and the system returns to the START condition. Thus far, the peak-to-peak check has been performed to determine that a signal of sufficient amplitude is present thereby eliminating low level noise signals. The additional check by latch circuit 42 is a phase check which will further eliminate noise signals and signals derived by detecting metallic objects along a track, other than a track marker, such as railroad switches.

A subsequent step labeled INCREMENT COUNTER forms the previously mentioned discrimination process of ensuring that a signal having the prescribed amplitude and phase relationship exists for a predetermined period of time. Thus, counter 52 begins counting clock pulses as long as the latch circuit 42 indicates that a signal has been detected which has the prescribed amplitude and phase conditions. A subsequent decisional step checks to determine the count and for those periods when it is less than the exemplified period of eight clock cycles, the system is returned to the START condition permitting the continued incrementing of the counter. When the final count of eight is achieved, the full discrimination process has been achieved and a "MARK" signal will be generated at the output 53 (point "K") of counter 52. Subsequently, the system will return to a START condition for further operation. Thus, as will be appreciated from the flow chart of FIG. 7, three tests of discrimination are performed, namely, amplitude, phase relationship and existence for a preselected count.

Figure 4:
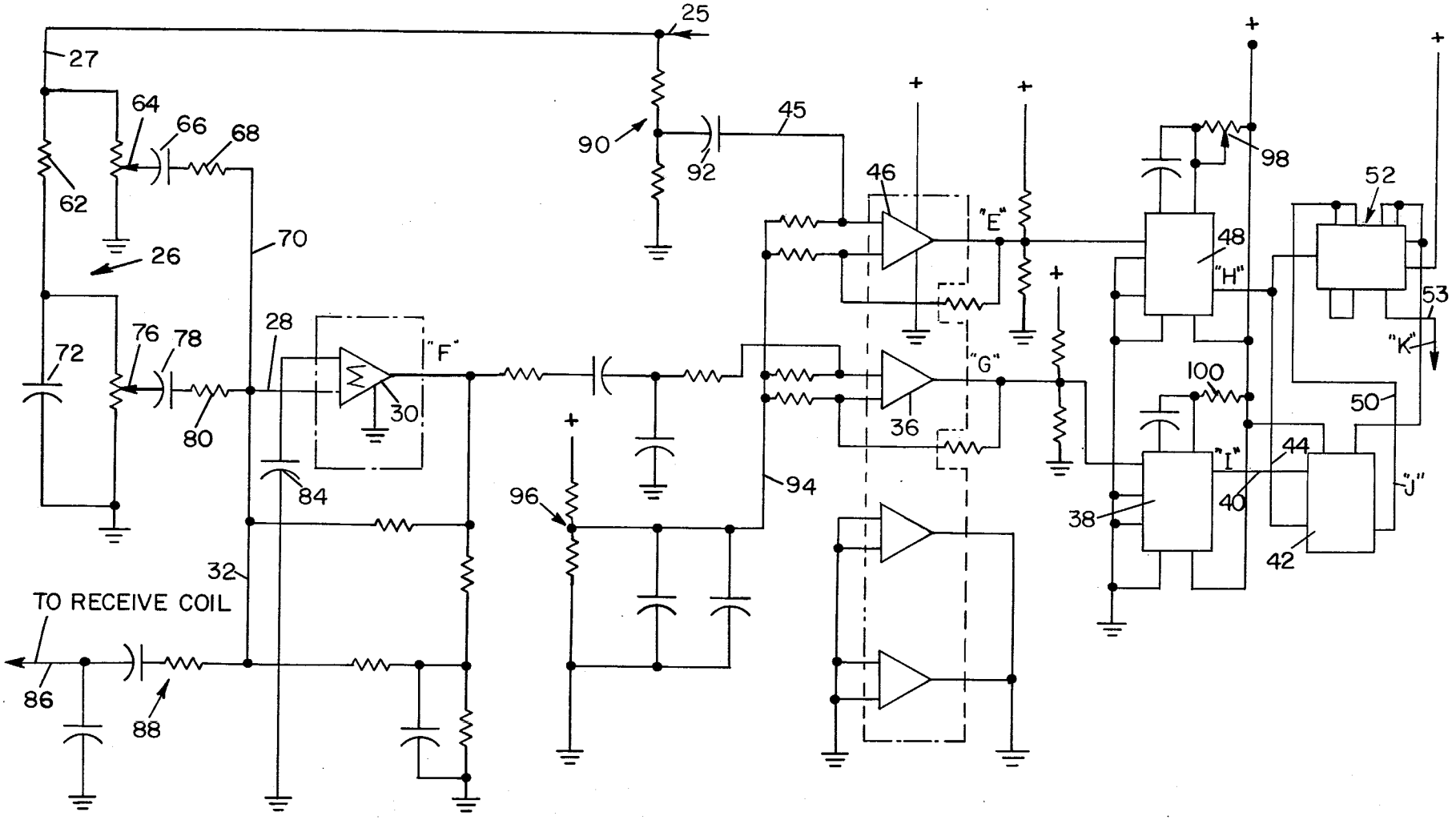
FIG. 4 is a schematic diagram of the signal discriminating portion of the present invention.

FIG. 4 is a schematic diagram of the discriminating portion of the system previously shown in block diagram form in FIG. 2. Specifically, FIG. 4 illustrates in detail the circuitry following the second amplifier 22 (FIG. 2). Further, the signal points "A"–"K" are shown at corresponding points in both FIGS. 2 and 4.

The amplified sine wave from lead 25 is conducted to the input 27 of the phase and amplitude adjustment circuit 26. This conduit includes a resistor 62 connected across a potentiometer 64. The purpose of the resistor 62 and potentiometer 64 is to vary the amplitude of the signal delivered at input 27. A DC blocking capacitor 66 couples the amplitude adjusted sine wave to the input 28, via coupling resistor 68 and lead 70 of the summing amplifier 30 which is of a conventional operational amplifier type available in chip form and designated in the industry as a LM 381 chip such as available from National Semiconductor Corporation. The phase adjustment to the signal presented at 27 occurs across the parallel RC configuration including capacitor 72 and potentiometer 76. The phase adjusted signal is also fed to the input 28 of summing amplifier 30, through the DC blocking capacitor 78 and coupling resistor 80, which are serially connected between the potentiometer 76 and the input 28. A ground return from a second input of the summing amplifier 30 is provided through grounded capacitor 84.

Lead 86 is connected to the receive coil (see FIG. 3), and RC components 88 couple the received signal to the input 28 of summing amplifier 30. As a result, the summing amplifier 30 sums the amplitude and phase adjusted signal from circuit 26 with the received signal from the received coil. As previously mentioned, the phase adjustment includes a phase shift of 180 degrees, of the signal presented at input 27. The amplitude adjustment is made so that a signal at lead 70 has the same amplitude as the interference signal introduced from the receive coil due to the signal coupled to the receive coil from the transmit coil.

Figure 5:
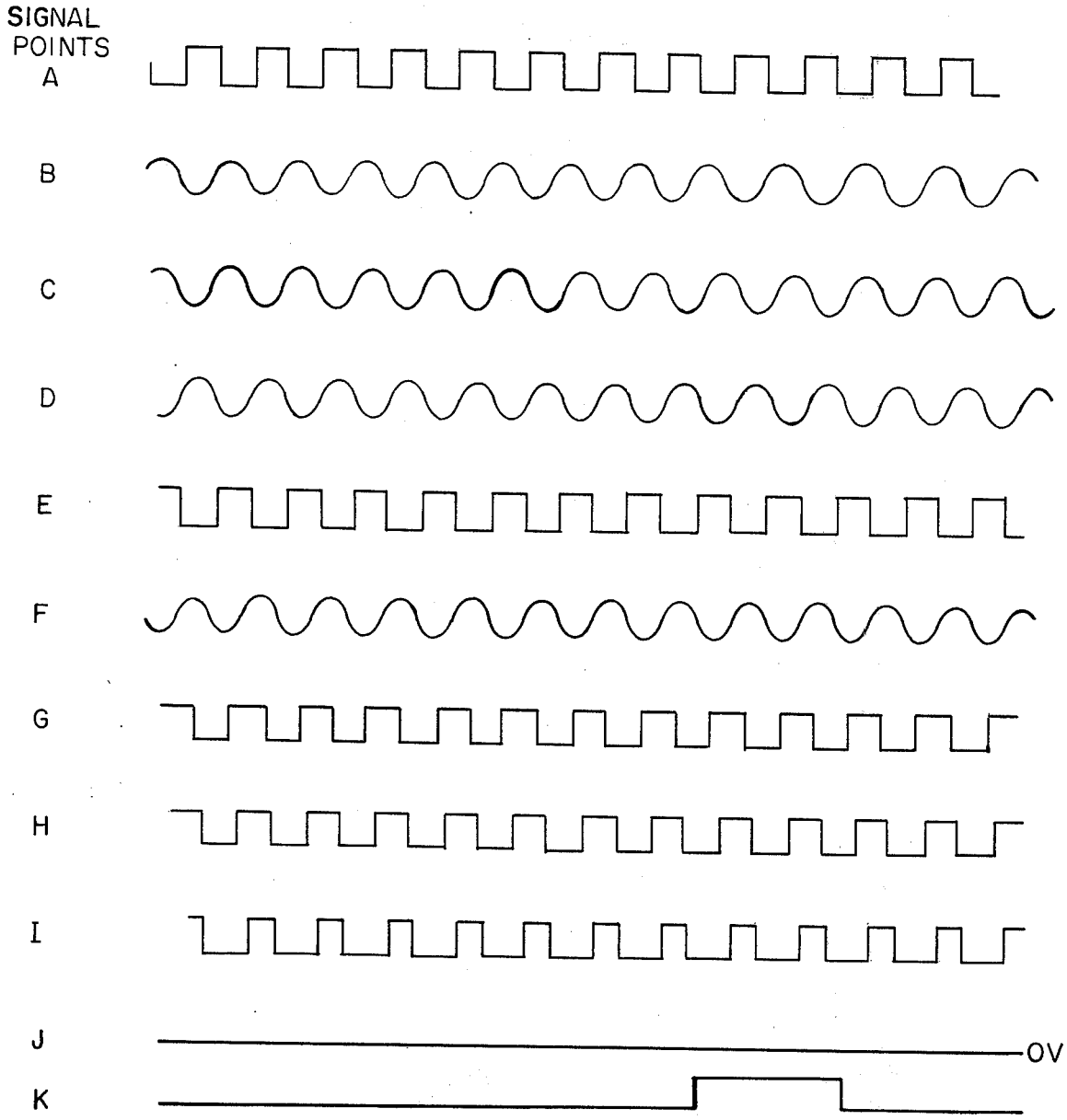
FIG. 5 is a timing chart showing various signals as they exist in the system of the invention.

FIG. 5 illustrates the signal "A"–"E", these signals being the same during the entire operation of the system. However, the indicated signal for point "F" is only sinusoidal when a track marker is encountered by the locomotive. Otherwise, the signal at point "F" would not exist.

Figure 6:
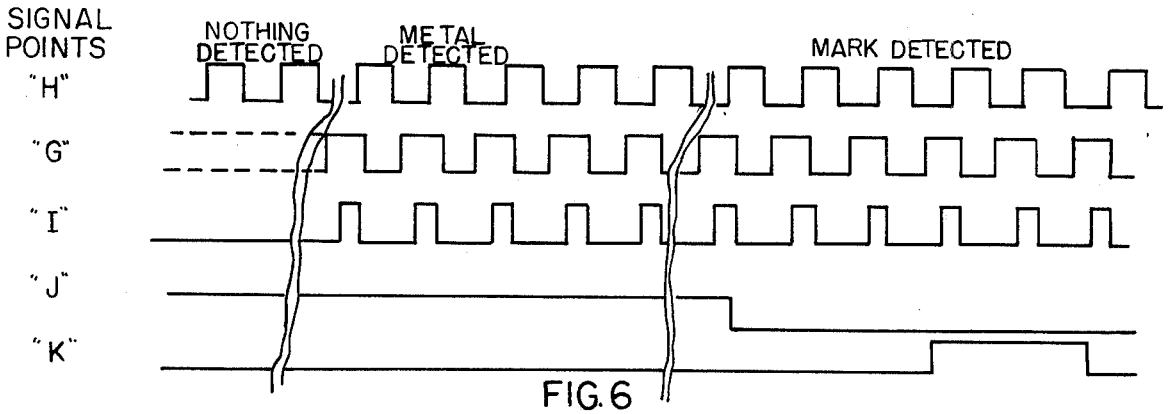
FIG. 6 is a timing chart showing various signals as they exist in the inventive system for different conditions.

The output from the summing amplifier 30 is fed to a conventional zero crossing detector 36 along with a DC reference voltage obtained from the voltage divider 96. The reference voltage is coupled to the detector 36 along lead 94. The detector 36 may be of the type available in chip form and identified in the industry by model No. LM 339, such as provided by National Semiconductor Corporation. At the output of zero crossing detector 36 is signal point "G" which represents a pulse train shown in FIG. 5. It is noted that the signal plots at points "G"–"K" in FIG. 5 are shown as they exist when a target marker is encountered. The interrelationship between these signals for different types of conditions is illustrated in FIG. 6.

The output from the detector 36 is fed to the one shot 38 where a new pulse train is formed having shorter pulse width, as indicated by the signal at point "I" in FIG. 5. The pulse width is fixed by the load resistor 100. A typical one shot is the type known in the industry, in chip form, as model SN 74121N and is provided by National Semiconductor Corporation. The output from the one shot 38 is coupled to latch circuit 42 to generate the signal at its output 50 which also represents joint "J". The latch circuit 42 is available in chip form and indicated by model No. 7474, available from National Semiconductor Corporation. The latch circuit has a second input available at 44 derived from the pulse delay 48 as previously discussed in connection with FIG. 2. The pulse delay 48 is also a one shot and may be identical to the previously mentioned one shot 38. The pulse width of the delay 48 is determined by the setting of voltage divider 98. The output from the pulse delay 48 carries the signal available at point "H". The input to the pulse delay 48 is the signal at point "E" which is generated by the zero crossing detector 46, which is identical to the previously mentioned zero crossing detector 36. Detector 46 has its input 45 connected to lead 25 through voltage divider 90, blocking capacitor 92. It is again observed that the timing signals at points "E" and "H" remain the same regardless of what is encountered by the system.

At the latch circuit 42, when the signal at point "I" is positive at the initiation of a clock pulse from the signal at point "H" , a track marker is detected. This is seen from FIG. 6 by the time chart section indicated as MARK DETECTED. However, in the event that the signal at point "I" is not positive during the leading edge of a clock pulse from the signal at point "H", the latch circuit 42 will not be set which is an interpretation that metal, such as a railroad switch, has been detected, not a track marker. The possible phase differences of the signal at point "I" , relative to the signal at point "H" is due to the fact that the track marker is driven at a frequency above its resonant frequency so that the discussed phase relationships will occur when a track marker is encountered. On the other hand, the detection of a passive metal object on a road bed will not cause the same phase condition to occur in the receive coil. Should nothing be detected, a signal at point "I" will not exist at all and will therefore not set the latch circuit 42. When the latch is set, indicating that a track marker has been detected, the set signal is generated at output 50 of the latch circuit 92 which corresponds with the signal at point "J". This signal drives counter 52 which is a commercially available counter-comparator signified by the industrial model No. 7490A, which is available from National Semiconductor Corporation. The counter 52 will count the clock pulses which occur while the latch remains set. Once a count of eight is detected, an output will occur at 53 corresponding with the signal at point "K". If the signal at point "J" changes during the count, the counter is reset to begin again. Further, after a successful count of eight and the generation of a mark detection signal at point "K", the counter is reset as is the latch circuit 42 to continue the detecting operation as a locomotive travels along.

As previously mentioned, the output at point 53 from the counter 52, corresponding with the signal at point "K" is fed to the event recorder 54 (FIG. 2) so that the occurrence of this event may be recorded for further utilization by a locomotive recorder system such as disclosed in the previously mentioned U.S. Pat. No. 3,864,731.

Although the present invention has been discussed in terms of a railroad locomotive, it is emphasized that this is merely a preferred embodiment of the invention. Indeed, the present system is completely adaptable and is intended to cover the other types of vehicles.

It should be understood that the invention is not limited to the exact details of construction shown and described herein for obvious modifications will occur to persons skilled in the art.

The following is claimed

1. A vehicle position detector comprising:
means for generating an oscillating signal;
a transmit coil mounted on the vehicle and connected to the output of the generating means for radiating an electromagnetic signal having the frequency of the oscillating signal;
a receive coil mounted on the vehicle in proximity to the transmit coil;
means connected to the receive coil for canceling any interferring signal induced in the receive coil as a result of its proximity to the transmit coil;
means connected to the output of the canceling means for detecting a position indicating signal which exceeds a predetermined amplitude;
means connected in circuit with the output of the detecting means for sampling the output at predetermined clocking intervals to determine the phase relation between a detected signal and a clocking signal having the same frequency as the generating means, the sampling means latching into a set state when a preselected phase relation exists; and
counter means responsive to the latching of the sampling means for a predetermined count, the counter means generating a signal indicating that a preselected position has been detected.

2. The subject matter set forth in claim 1 together with a path marking means positioned at a preselected point along the path of vehicle travel, the marking means having a resonant frequency different that the frequency of the generating means, the marking means coupling the position indicating signal to the receive coil.

3. The subject matter set forth in claim 1 together with recording means connected to the output of the counter means for storing the occurrence of the signal indicative of a preselected position.

4. The subject matter set forth in claim 1 wherein the canceling means comprises:
means connected to the output of the generating means for adjusting the amplitude of the signal derived from the generating means to match that of the interferring signal;
means connected to the generating means output for adjusting the phase of the signal derived from the generating means by 180°;
means for connecting the phase and amplitude adjusted signals together to form a composite signal which is of equal amplitude but opposite polarity from the interferring signal;
summing means connected at its input to the composite signal and the output of the receive coil for passing a signal therethrough which is not an interferring signal.

5. The subject matter set forth in claim 1 wherein the detecting means includes a zero crossing detector.

6. The subject matter set forth in claim 1 together with a clock generator comprising:
a zero crossing detector connected at its input to the generator means for converting a sine wave oscillation signal to a pulse signal; and
means connected at its input to the zero crossing detector for adjusting the pulse width of each pulse in the pulse signal.

7. The subject matter set forth in claim 6 wherein the sampling means is a latch circuit having a first input connected in circuit with the output of the preselected amplitude detecting means, a second input being connected in circuit with the clock generator.

8. The subject matter set forth in claim 6 wherein the counter means is a counter which is incremented by the clock generator when the sampling means is in the set state.

9. A vehicle position detector comprising:
means for generating an oscillating signal;
a transmit coil mounted on the vehicle and connected to the output of the generating means for radiating an electromagnetic signal having the frequency of the oscillating signal;
a receive coil mounted on the vehicle in proximity to the transmit coil;
means connected to the receive coil for canceling any interferring signal induced in the receive coil as a result of its proximity to the transmit coil, the canceling means including:
means connected to the output of the generating means for adjusting the amplitude of the signal derived from the generating means to match that of the interferring signal;
means connected to the generating means output for adjusting the phase of the signal derived from the generating means by 180 degrees;
means for connecting the phase and amplitude adjusted signals together to form a composite signal which is of equal amplitude but opposite polarity from the interferring signal;
summing means connected at its input to the composite and the output of the receive coil for passing a signal therethrough which is not an interferring signal;
means connected to the output of the cancelling means for detecting a position indicating signal which exceeds a preselected amplitude;

means connected in circuit with the output of the detecting means for sampling the output at predetermined clocking intervals to determine the phase relation between a detected signal and a clocking signal having the same frequency as the generating means, the sampling means latching into a set state when a preselected phase relation exists, the sampling means being a latch circuit having a first input connected in circuit with the output of the preselected amplitude detecting means, a second input being connected in circuit with the clock generator;

counter means responsive to the latching of the sampling means for a predetermined count, the counter means generating a signal indicating that a preselected position has been detected; and path marking means positioned at a preselected point along the path of vehicle travel, the marking means having a resonant frequency different than the frequency of the generating means, the marking means coupling the position indicating signal to the receive coil.

10. A method for detecting the passage of a vehicle over a premarked point along the path of vehicle travel, the method including the following steps:

transmitting a signal of a preselected frequency as the vehicle moves along the path thus establishing an emf;

receiving a signal coupled through the path, the signal being dependent upon objects encountered along the path;

canceling from a receive signal the interference caused by the transmitting;

measuring the received signal for determining whether it meets a predetermined minimum amplitude;

measuring the phase relationship between transmitted and received signals, only if the minimum amplitude is met, to determine if a preselected phase relation exists;

counting intervals for the received signal, only when the predetermined amplitude and phase conditions are met; and generating a detecting signal when a preselected interval count is achieved.

11. The subject matter set forth in claim 10 together with the step of driving a circuit, located along the path, with the transmitted signal at a frequency slightly higher than the resonant frequency of the circuit thereby causing a particular phase relation to occur between the transmitted and received signals.

* * * * *

UNITED STATES PATENT OFFICE

CERTIFICATE OF CORRECTION

Patent No. 4,041,448 Dated August 9, 1977

Inventor(s) Richard H. Noens

It is certified that error appears in the above-identified patent and that said Letters Patent are hereby corrected as shown below:

Column 2, line 11, "included" should be --induced--; line 15, "or" should be --of--; line 39, "member" should be --marker--.

Column 5, line 40, "conduit" should be --circuit--; line 64, "received" should be --receive--.

Column 6, line 3, after "signal" insert --points--; line 31, "joint" should be --point--.

Column 7, line 3, "92" should be --42--; line 28, after "cover" delete "the".

Claim 2, at line 63, "that" should be --than--.

Claim 9, line 63, before "and" insert --signal--.

Signed and Sealed this

*Twentieth* Day of *December 1977*

[SEAL]

*Attest:*

RUTH C. MASON
*Attesting Officer*

LUTRELLE F. PARKER
*Acting Commissioner of Patents and Trademarks*